US010280621B2

(12) United States Patent
Munsell et al.

(10) Patent No.: US 10,280,621 B2
(45) Date of Patent: May 7, 2019

(54) METHOD OF TYING A REBAR TIE

(71) Applicant: A NEW TWIST LLC, Chula Vista, CA (US)

(72) Inventors: Clyde Stephan Munsell, Chula Vista, CA (US); James Dalgleish Reid, San Diego, CA (US)

(73) Assignee: A NEW TWIST LLC, Chula Vista, CA (US)

( * ) Notice: Subject to any disclaimer, the term of this patent is extended or adjusted under 35 U.S.C. 154(b) by 0 days.

(21) Appl. No.: 15/932,423

(22) Filed: May 23, 2016

(65) Prior Publication Data

US 2018/0266110 A1 Sep. 20, 2018

Related U.S. Application Data

(63) Continuation-in-part of application No. 14/681,897, filed on Apr. 8, 2015, now Pat. No. 10,106,984.

(51) Int. Cl.
*E04C 5/16* (2006.01)

(52) U.S. Cl.
CPC ..... *E04C 5/166* (2013.01); *E04C 5/163* (2013.01)

(58) Field of Classification Search
CPC ..... E04C 5/166; E04C 5/163; E04B 1/58
USPC ..... 52/698, 712, 855, 856, 857
See application file for complete search history.

(56) References Cited

U.S. PATENT DOCUMENTS 735,228 A * 8/1903 Ellinger ..... E04C 5/167 52/719
919,099 A * 4/1909 Wedmore ..... E04C 5/167 52/685
1,046,913 A * 12/1912 Weakley ..... E04C 3/08 52/633
1,149,648 A * 8/1915 Henderson ..... E04C 5/167 52/719
1,158,957 A 11/1915 Bates
1,185,764 A * 6/1916 Brooks ..... E04C 5/168 52/685
1,692,166 A * 11/1928 Gates ..... E04G 17/0754 249/215
1,838,124 A * 12/1931 White ..... E04C 5/166 52/719
3,728,836 A * 4/1973 Gates ..... E04G 17/0754 249/215
4,096,680 A * 6/1978 Ritter ..... E04C 5/04 52/665
4,375,118 A 3/1983 Saylor
(Continued)

FOREIGN PATENT DOCUMENTS

RU 2111323 C1 * 5/1998

*Primary Examiner* — Brent W Herring
(74) *Attorney, Agent, or Firm* — S&L US IP Attorneys, P.C.; Timothy Marc Shropshire; Eric Brandon Lovell

(57) ABSTRACT

A method for securing rebar prior to concrete pour consists of tying, by hand in a series of unique steps, a piece of wire with 2-inch loops on either end around the rebar at joints where the rebar sections come together. The present method is used in place of a mechanical system as required in the prior art and requires no tools or other devices. Execution of the present method is up to 7 times faster and results in a stronger tie than other tying methods. The present method provides substantial savings in manpower and time on any application requiring reinforced concrete.

10 Claims, 7 Drawing Sheets

(56) References Cited

U.S. PATENT DOCUMENTS

| | | | | |
|---|---|---|---|---|
| 5,054,614 | A * | 10/1991 | Glaus | E04G 21/122 206/343 |
| 5,275,383 | A * | 1/1994 | Wick | E04H 17/268 256/47 |
| 5,699,642 | A | 12/1997 | McDevitt, Jr. | |
| 6,142,451 | A * | 11/2000 | Lindsey | B65H 75/06 242/405.1 |
| 6,354,054 | B1 * | 3/2002 | Verelli | E04C 5/168 248/440 |
| 6,503,434 | B1 * | 1/2003 | Mayer | E04C 5/166 264/273 |
| 6,655,105 | B2 * | 12/2003 | Swenson | E04C 5/163 403/391 |
| 7,174,685 | B2 * | 2/2007 | Hayes | E04C 5/12 52/223.6 |
| 8,112,964 | B2 * | 2/2012 | Baruh | E04C 5/167 52/685 |
| 2003/0024204 | A1 | 2/2003 | Swenson | |
| 2004/0148880 | A1 * | 8/2004 | Hayes | E04C 5/12 52/223.1 |
| 2009/0145074 | A1 | 6/2009 | Tsukamoto | |
| 2009/0188200 | A1 | 7/2009 | Kelly | |
| 2010/0000173 | A1 * | 1/2010 | Thompson | B28B 23/0025 52/689 |
| 2015/0211232 | A1 * | 7/2015 | Baruh | E04C 5/167 52/719 |

* cited by examiner

METHOD OF TYING A REBAR TIE

CROSS-REFERENCE TO RELATED APPLICATION(S)

The present application claims priority to U.S. Non-provisional patent application Ser. No. 14/681,897 filed on Apr. 8, 2015, entitled "TOOL FREE REBAR TIE", the entire disclosure of which is incorporated by reference herein.

BACKGROUND OF THE INVENTION

Field of Invention

The present invention relates generally to methods of securing rebar sections together while constructing a grid to reinforce concrete once it has been poured. When an application of concrete requires additional strength, the concrete is reinforced by laying a grid of steel rods, i.e., rebar, prior to pouring the concrete. At any point where rebar sections intersect, a wire is wrapped around the joint, or intersection, so the rebar sections do not move during the pour. The basic method for applying this wire has changed little over the years. A piece of wire with small loops at each end is placed around the rebar joint. The loops are then secured to the pegs of a tool used to wrap the wire a single time around the joint, securing it in place. In the alternative, wire is hand-fed from a roll, cut with pliers, wrapped around the intersection and, finally, hand-twisted tight into place with pliers.

Either of the foregoing prior art processes is cumbersome, especially when the construction worker is wearing gloves to protect his/her hands. The present method removes the necessity for a tool by enlarging the loops on the ends of the wire. This provides a means for a worker to place his/her fingers, even with gloves on, through the loops on the ends of the wire. Additionally, the present invention provides, through a series of steps, a means to wrap the wire twice around the rebar. Further, the wire ends are twisted and trimmed to mitigate danger to bare hands. Execution of the present method is up to 7 times faster and results in a stronger tie than other tying methods, providing substantial savings in manpower and time for any construction job where reinforced concrete is required.

Description of Related Art

The prior art consists of apparatuses, systems, and methods for tying rebar using tools. For example, U.S. Pat. No. 1,158,957, directed to a wire tie used for securing rebar in reinforced concrete projects, was granted in 1915 to Aldemer Bates et al. (hereinafter "Bates"). The present method is executed using a rebar tie, configured to be manipulated entirely by hand, producing an extraordinary and unexpected result over the prior art.

SUMMARY OF THE INVENTION

In view of the forgoing inefficiency inherent in the prior art methods of tying rebar, the present method provides substantial time and labor savings on any construction site where reinforced concrete is required.

The general purpose of the present method, which shall be described subsequently in greater detail, is to provide an improved method of securing rebar in a grid prior to a concrete pour. The present method has advantages over the prior art methods mentioned heretofore and novel features that result in more efficient wire ties to secure the rebar reinforcements, none of which are anticipated, rendered obvious, suggested or even implied by any of the prior art systems, either alone or in combination.

The present method provides a series of steps combined with a unique section of wire 8 to 12 inches long having two large loops, one at either end, allowing the user to attach the wire to the rebar faster and without the use of a mechanical device.

A primary objective of the present method is to provide an improvement in efficiency of joining rebar without the need for tools or mechanical devices to form a grid in reinforced concrete construction projects that will overcome the shortcomings of the prior art.

In contrast to the prior art, the present invention eliminates the need for a tool or other mechanical device by increasing the size of the loops to two inches in diameter so that the user may place his/her fingers through the loops. Further, the present method provides specific steps to tie the wire by hand, which is both faster and stronger than the previous industry standard.

The foregoing, and other features and advantages of the invention, will be apparent from the following, more particular description of the preferred embodiments of the invention, the accompanying drawings, and the claims.

BRIEF DESCRIPTION OF THE DRAWINGS

Various other features and attendant advantages of the present invention will become fully appreciated as the same become better understood when considered in conjunction with the accompanying drawings, in which like reference characters designate the same or similar parts throughout the several views. All references to direction, i.e., up, down, and counter-clockwise, assume the operator is applying the tie from above the rebar joint/intersection.

DETAILED DESCRIPTION OF PREFERRED EMBODIMENTS

All references to direction, i.e., up, down, and counter-clockwise, assume the operator is applying the tie from above the rebar joint/intersection.

Figure 1:
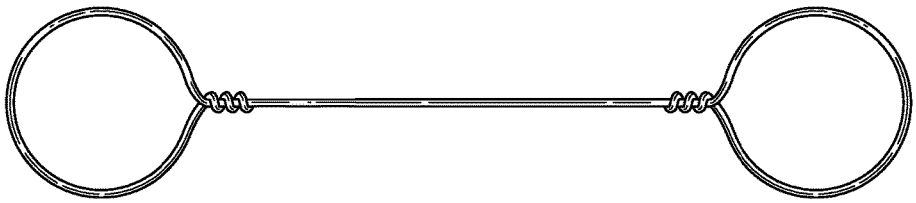
FIG. 1 is a top plan view of the rebar tie, according to an embodiment of the present invention.
Figure 2:
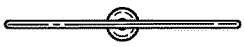
FIG. 2 is a front elevational view of the rebar tie, according to an embodiment of the present invention.
Figure 3:
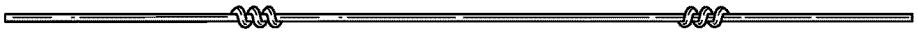
FIG. 3 is a side elevational view of the rebar tie, according to an embodiment of the present invention.

FIGS. 1-3 show a rebar tie to join rebar sections in reinforced concrete projects. The tie consists of a single section of 16-gauge steel wire with a 2-inch diameter loop at each end. The single section is between 8 and 12 inches long to allow for different size rebar which may be found on construction sites.

FIGS. 4-9 illustrate detailed steps of tying the rebar tie around intersecting sections of rebar, according to an embodiment of the present invention.

Figure 4:
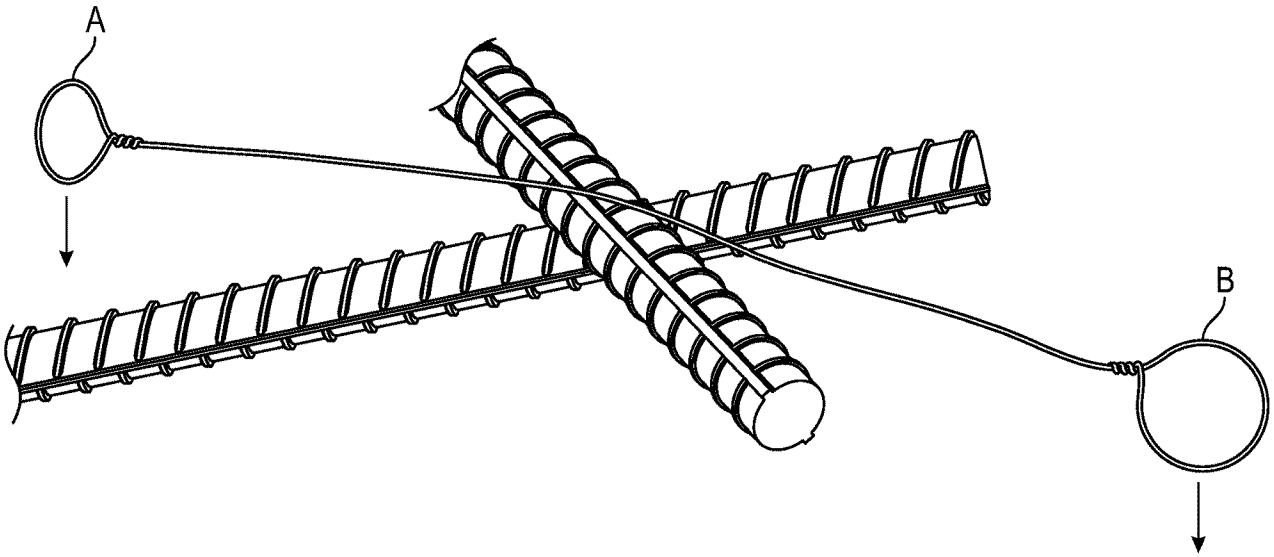
FIG. 4 is a perspective view of the rebar tie engaging with two sections of rebar, according to an embodiment of the present invention.

With reference to FIG. 4, at step 1 the rebar tie is positioned diagonally across a rebar intersection/joint to initiate the tying process. Loop A is positioned over a first quadrant and loop B is positioned over a second quadrant. The arrows indicate a downward movement of the loops A, B as the tying process moves from step 1 through step 2.

Figure 5:
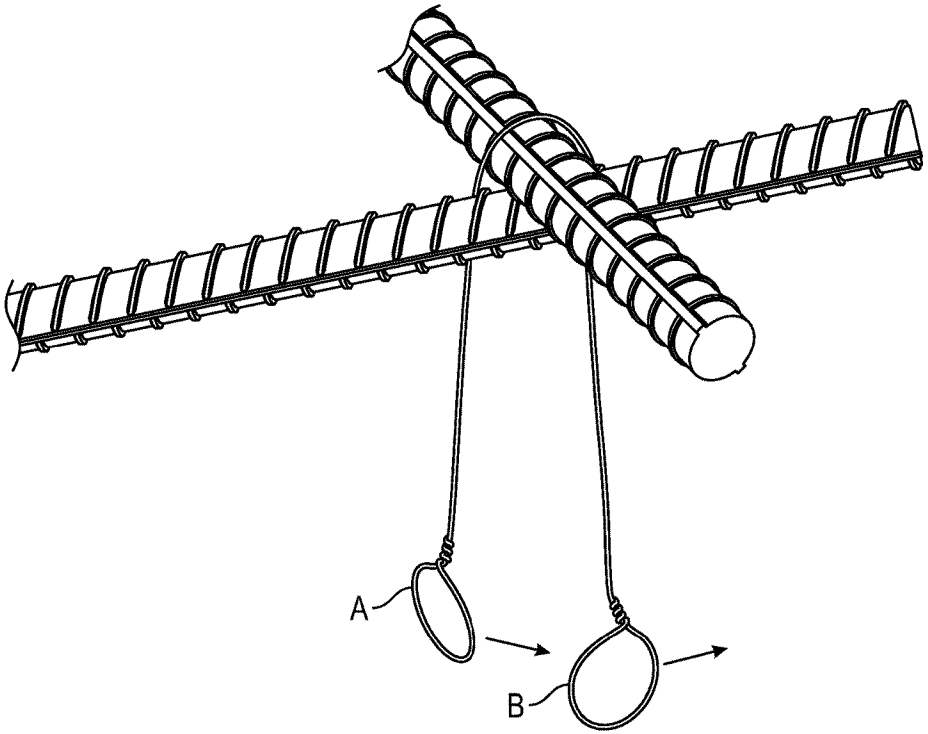
FIG. 5 is a perspective view of the rebar tie engaging with two sections of rebar, according to an embodiment of the present invention.

With reference to FIG. 5, at step 2 the loops A, B are pushed down through the first and second quadrants, respectively. The arrows indicate the counter-clockwise motion of the loops A, B as the tying process moves from step 2 to step 3.

Figure 6:
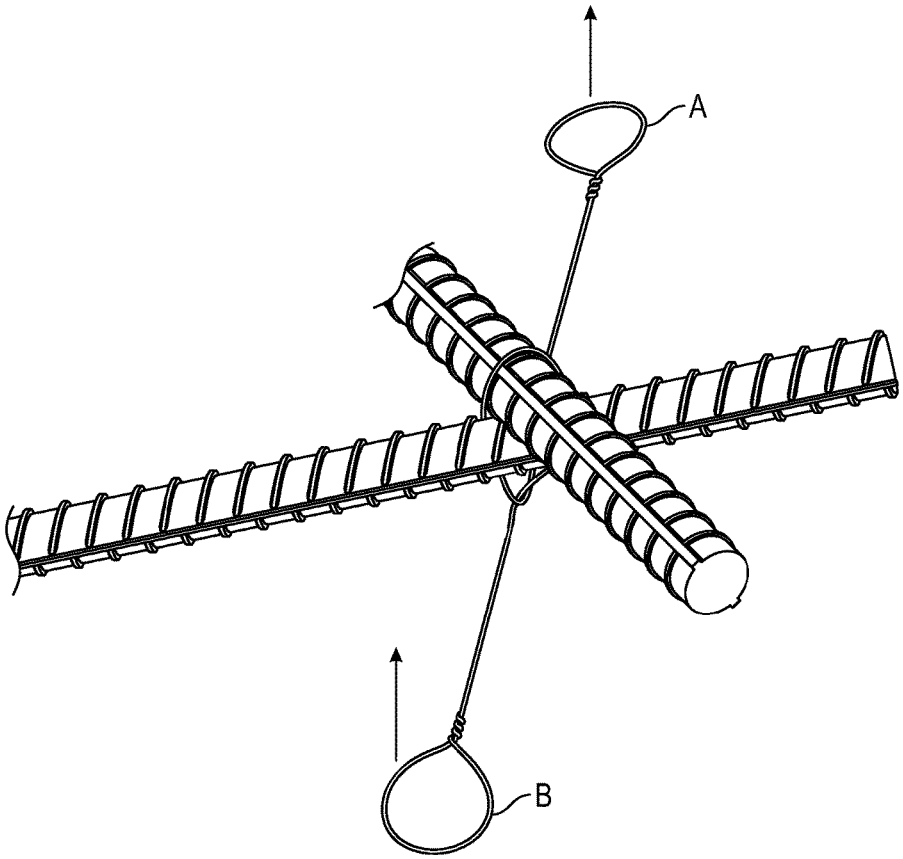
FIG. 6 is a perspective view of the rebar tie engaging with two sections of rebar, according to an embodiment of the present invention.

With reference to FIG. 6, at step 3 the rebar tie is twisted 270 degrees, tightly in a counter-clockwise direction, below the rebar intersection. In an embodiment, the 270-degree twist is accomplished by gripping the loops A, B, twisting the rebar tie 180 degrees, releasing the loops A, B, regripping the loops A, B, and twisting the rebar tie an additional 90 degrees. The arrows indicate an upward movement of the loops A, B through a third and a fourth quadrant, respectively, as the tying process moves from step 3 through step 4.

Figure 7:
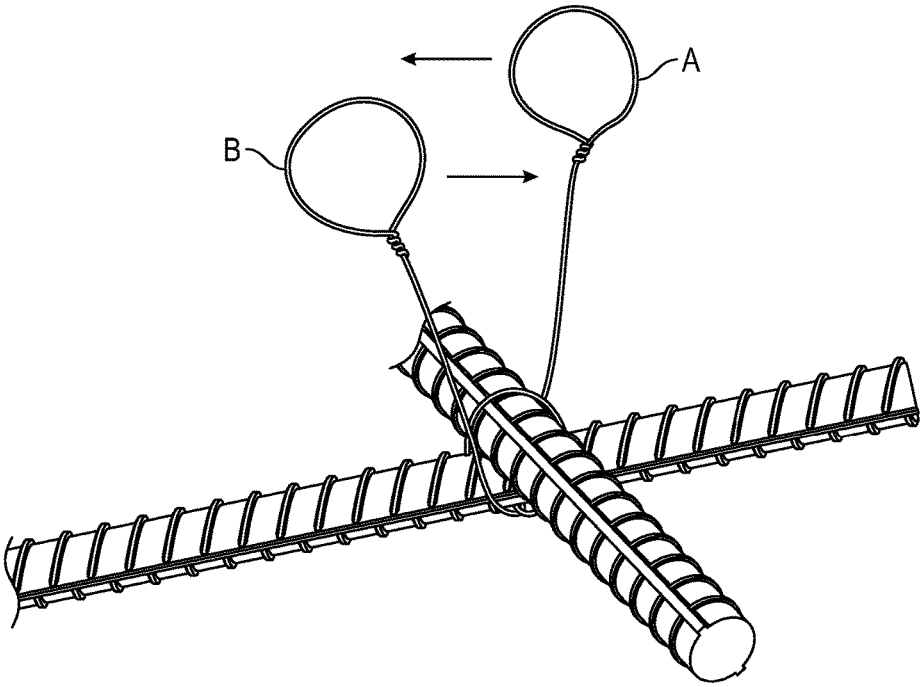
FIG. 7 is a perspective view of the rebar tie engaging with two sections of rebar, according to an embodiment of the present invention.

With reference to FIG. 7, at step 4 the loops A, B are pulled up through the third and fourth quadrants, respectively. The arrows indicate the counter-clockwise motion of the loops A, B as the tying process moves from step 4 to step 5.

Figure 8:
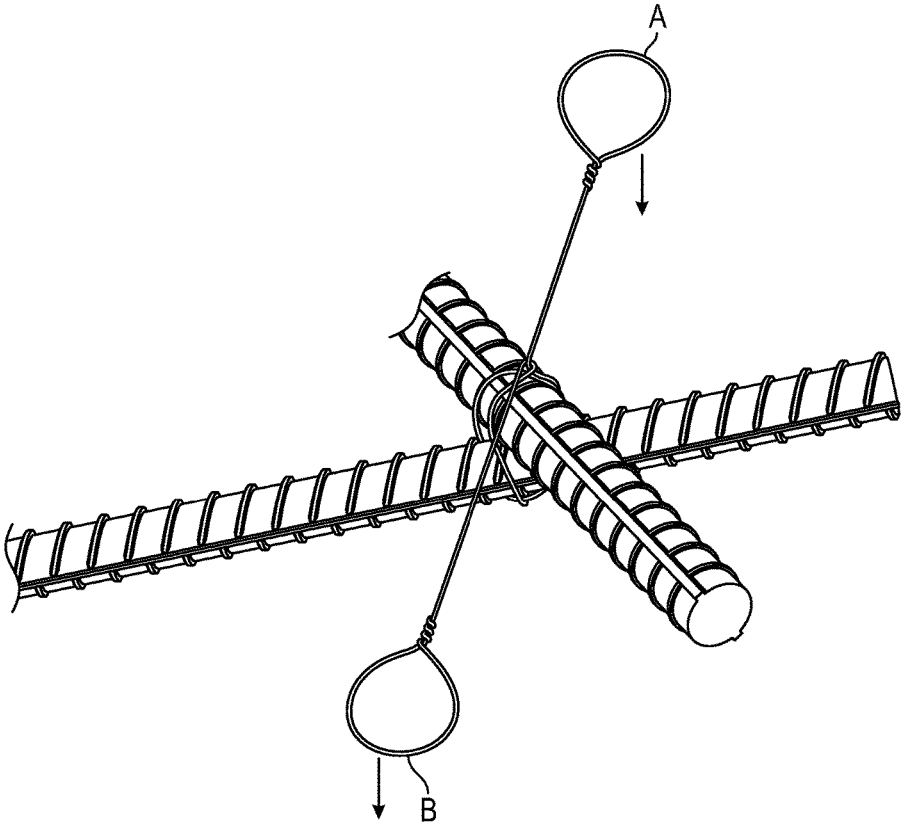
FIG. 8 is a perspective view of the rebar tie engaging with two sections of rebar, according to an embodiment of the present invention.

With reference to FIG. 8, at step 5 the rebar tie is twisted 180 degrees twice, i.e., 360 degrees total, tightly in a counter-clockwise direction, above the rebar intersection. In an embodiment, the 360-degree twist is accomplished by gripping the loops A, B, twisting the rebar tie 180 degrees, releasing the loops A, B, regripping the loops A, B, and twisting the rebar tie an additional 180 degrees. The arrows indicate a downward movement of the loops A, B through the third and fourth quadrants, respectively, as the tying process moves from step 5 through step 6.

Figure 9:
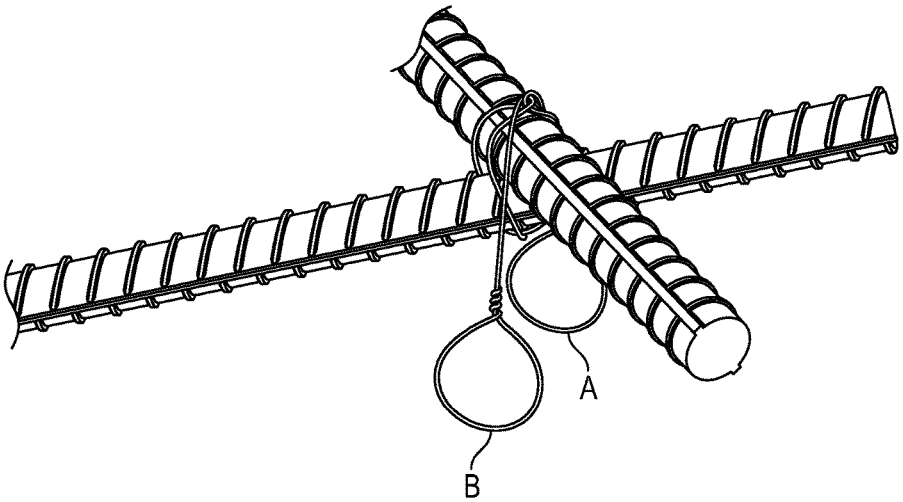
FIG. 9 is a perspective view of the rebar tie engaging with two sections of rebar, according to an embodiment of the present.

With reference to FIG. 9, at step 6 the loops A, B are pushed down through the third and fourth quadrants, respectively, where they are tucked down and away.

Generally, the user wraps the wire around the rebar joint, i.e., anyplace where the two pieces of rebar intersect and, using the loops as fingerholds, twists the wire tightly around the joint to secure the rebar and ensure integrity of the grid so the rebar does not move when the concrete is poured.

The invention has been described herein using specific embodiments for the purposes of illustration only. It will be readily apparent to one of ordinary skill in the art, however, that the principles of the invention can be embodied in other ways. Therefore, the invention should not be regarded as being limited in scope to the specific embodiments disclosed herein, but instead as being fully commensurate in scope with the following claims.

I claim:

1. A method of tying a rebar tie comprising the steps of:

a. wrapping a middle section of the tie around a rebar intersection; and b. twisting the middle section upon itself to secure the tie in place around the rebar intersection, wherein the tie includes a first loop and a second loop, wherein the middle section separates the first loop from the second loop, wherein the first loop, the second loop, and the middle section are collectively constructed from a single, continuous piece of metal wire, wherein the first loop and the second loop each have a diameter of two inches and are configured to receive a user's finger therethrough, such that the user may wrap the middle section around the rebar intersection using the first loop and the second loop as finger holds for leverage while tying the tie.

2. The method of claim 1, wherein the steps of wrapping the middle section of the tie around the rebar intersection and twisting the middle section upon itself to secure the tie in place around the rebar intersection comprise the steps of:

a. laying the tie across a first side of the rebar intersection, wherein the first loop is positioned adjacent to a first quadrant of the rebar intersection and the second loop is positioned adjacent to a second quadrant of the rebar intersection, wherein the first quadrant and the second quadrant are diagonally opposed to one another;

b. passing the first loop and the second loop through the first quadrant and the second quadrant, respectively, to a second side of the rebar intersection;

c. twisting the tie 270 degrees on the second side;

d. passing the first loop and the second loop through a third quadrant and a fourth quadrant, respectively, to the first side;

e. twisting the tie 360 degrees on the first side; and f. tucking the first loop and the second loop adjacent to the rebar intersection.

3. The method of claim 2, wherein the steps of twisting the tie comprise twisting the tie counter-clockwise.

4. The method of claim 3, wherein the step of twisting the tie 270 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 90 degrees.

5. The method of claim 4, wherein the step of twisting the tie 360 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 180 degrees.

6. The method of claim 3, wherein the step of twisting the tie 360 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 180 degrees.

7. The method of claim 2, wherein the first side is a top side of the rebar intersection, and wherein the second side is a bottom side of the rebar intersection.

8. The method of claim 2, wherein the step of twisting the tie 270 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 90 degrees.

9. The method of claim 8, wherein the step of twisting the tie 360 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 180 degrees.

10. The method of claim 2, wherein the step of twisting the tie 360 degrees comprises the steps of:

i. gripping the first loop and the second loop;

ii. twisting the tie 180 degrees;

iii. releasing the first loop and the second loop;

iv. re-gripping the first loop and the second loop; and v. twisting the tie an additional 180 degrees.

* * * * *